United States Patent [19]

Hamanaka

[11] 4,187,669

[45] Feb. 12, 1980

[54] KNITTING MATERIAL

[75] Inventor: Rikio Hamanaka, Kyoto, Japan

[73] Assignee: Hamanaka Kabushiki Kaisha, Kyoto, Japan

[21] Appl. No.: 872,660

[22] Filed: Jan. 26, 1978

[30] Foreign Application Priority Data

Feb. 1, 1977 [JP] Japan ..... 52-10439
Aug. 9, 1977 [JP] Japan ..... 52-106877[U]

[51] Int. Cl.[2] ..... D02G 3/06; D02G 3/44
[52] U.S. Cl. ..... 57/235; 57/260
[58] Field of Search ..... 57/154, 155, 167, 31, 57/200, 235, 260; 66/202; 428/364, 365, 296

[56] References Cited

U.S. PATENT DOCUMENTS

| | | | |
|---|---|---|---|
| 1,995,696 | 3/1935 | Wallach | 57/235 |
| 2,156,332 | 5/1939 | Cote | 57/235 X |
| 2,500,282 | 3/1950 | Francis, Jr. | 428/296 |
| 2,721,462 | 10/1955 | Marks | 66/202 X |
| 3,226,958 | 1/1966 | Niemer et al. | 66/202 |
| 3,354,630 | 11/1967 | Segal | 57/235 |
| 3,595,731 | 7/1971 | Davies et al. | 428/296 X |
| 3,732,708 | 5/1973 | Troy | 66/202 X |
| 4,091,140 | 5/1978 | Harmon | 428/296 |

*Primary Examiner*—Donald Watkins
*Attorney, Agent, or Firm*—Blanchard, Flynn, Thiel, Boutell & Tanis

[57] ABSTRACT

Knitting material for handicraft or mechanical knitting operations which comprises a fine tape comprised of a non-woven fabric prepared by the spun-bond process, said tape having been obtained by slitting said non-woven fabric, said tape having a weight unit per area of not more than 30 g/m$^2$ and having from 2 to 20 turns per one meter lengthwise.

8 Claims, 2 Drawing Figures

KNITTING MATERIAL

This invention relates to a knitting material comprised of a non-woven fabric which is light-weight and washable, and is capable of being knitted on a knitting machine as well as by handicraft working.

In general, various kinds of handicraft articles and knitted articles have been previously made of various kinds of conventional knitting yarns which are manufactured by the conventional yarn manufacturing process. The knitting yarns for handicraft use are, however, inappropriate for knitting on a knitting machine and they do not have a sufficient strength for laundering, etc., so that there still remains to be solved the problem of laundering durability. The fiber industry has achieved remarkable developments in recent years and, notably, non-woven fabrics have been developed and they have been utilized for paddings, inside belts and various other applications. The non-woven fabrics have been usually manufactured by a process which comprises accumulating short cut fibers to make a web and subsequently uniting the web fibers by a needling operation or a binder. But a new process of manufacturing non-woven fabrics, namely, the so-called spun-bond process has been recently developed, in which filaments are melt spun are moved laterally back and forth and entangled (intertwined) and bonded together vertically and horizontally. In consequence of it, the range of use of non-woven fabric has been remarkedly increased.

The non-woven fabrics prepared by the spun-bond process can be more efficiently produced as compared with the production of conventional non-woven fabrics comprised of a web of short cut fibers. The non-woven fabrics prepared by the spun-bond process have good performances due to their continuous filaments, but it was technically difficult to manufacture a non-woven fabric having a weight per area of below 30 g/m$^2$, so that the use of non-woven fabrics for a knitting material was out of the question. Because of this, the use of non-woven fabrics as a knitting material for handicraft purposes almost has not been considered in this field. Therefore, knitting materials still have not gone beyond the limits of conventional knitting yarns. A non-woven fabric having a weight per square meter of about 20 gr. or below has been developed, which fact led to various attempts to find its new use as a knitting material or a knitting yarn for handicraft and mechanical knitting work. As a result, it was found that such a non-woven fabric prepared according to the spun-bond process and that has a low weight per unit area is satisfactory for use in the form of a finely-slit tape and this finding has matured as this invention.

Accordingly, a primary object of this invention is to provide a knitting material obtained by the use of a non-woven fabric prepared by the spun-bond process.

Another object of this invention is to provide a novel knitting material which is readily washable and is capable of being knitted on a knitting machine as well as with a handicraft needle such as a knitting needle or a crochet needle, thereby to increase the range of its use beyond handicraft articles.

A further object of this invention is to provide a knitted article having a good elongation recovery and made of the knitting material which is provided with a good elasticity and flexibility inherent in non-woven fabrics, thus to expand the use of non-woven fabrics which have previously been utilized only to make paddings, inside belts, etc.

A feature of this invention for accomplishing the foregoing objects resides in a finely-slit tape-like material of a non-woven fabric having a low twist of 2 to 20 turns per one meter lengthwise, which fabric is comprised of continuously spun filaments of a synthetic high polymer entangled or intertwined and bonded together vertically and horizontally and having a weight of not more than 30 g/m$^2$.

The other feature of this invention consists in a knitted article which is knitted of the foregoing knitting material by handicraft or general knitting operation. Here, when used for handicraft purposes, the knitting material includes the aforementioned tape-like material of a non-woven fabric twisted by itself, a plural number of the tape-like materials clustered and twisted together, a combination of the twisted tape-like material twisted and any other yarn clustered together, and a plaited cord comprised of 8 to 16 of the tape-like materials.

The invention will be further described hereinafter, by way of example, in conjunction with the accompanying drawings in which.

The non-woven fabric used in this invention has a weight of not more than 30 g/m$^2$, preferably about 20 g/m$^2$. It is prepared by the spun-bond process, namely, a process which comprises laterally moving back and forth continuous filaments of a synthetic high polymer, for example, nylon filament polyester filament, polypropylene filament and the like, just after they are melt-spun out of nozzles whereby to accumulate them crosswise and bonding them either by applying a binder or by making use of their self-adhesiveness without employing a binder. This kind of non-woven fabric is excellent in laundering property, unlike rayon and it is highly useful for this invention.

By the term "non-woven fabric prepared according to spun-bond process" used throughout the specification is thus meant such non-woven fabric as mentioned above.

Figure 1:
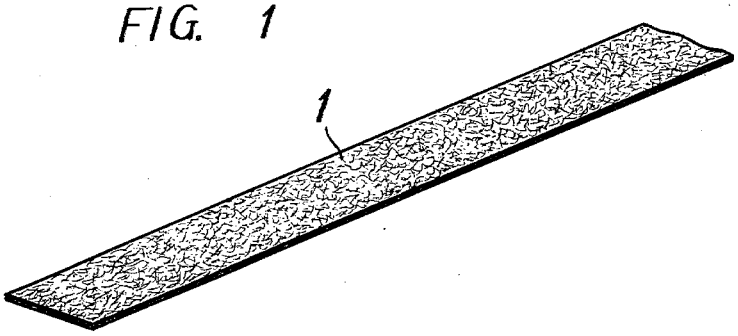
FIG. 1 is a perspective view showing a knitting material of this invention.

The non-woven fabric thus bonded is subsequently wound up in a roll form, and it is slit in a desired width, preferably 5 to 20 mm, most usually 12 to 15 mm, with a slitter to obtain a fine tape-like material as illustrated in FIG. 1. This fine tape-like material may be used as a handicraft yarn in that condition, but it is ordinarily twisted 2 to 20 turns per meter length in order to make the knitting work smooth. When the tape-like yarn of a non-woven fabric thus obtained having a low number of turns per meter is used, a plurality of the yarns, for example, 3 to 5 yarns may be subsequently clustered and twisted together to make a twisted yarn for a handicraft material. Further, 8 to 16 of the afore-mentioned fine tape-like materials of non-woven fabric may be made into a braided cord for handicraft with a conventional braider, as well.

When the knitting material described above is used for handicraft purposes, it may be knitted with a knitting needle or crochet needle in a similar manner to conventional handicraft art, or knitted on a synthetic resin network base by being intertwined in the meshes of it instead of by stitching, or knitted by other various knitting operations.

Alternatively, the knitting material may be knitted on a knitting device to make various kinds of knitted articles.

Figure 2:
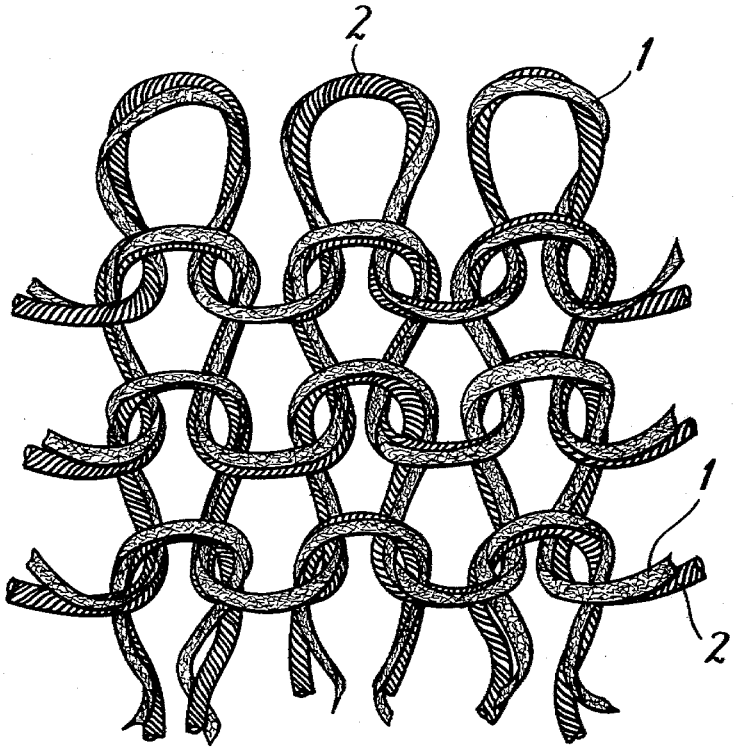
FIG. 2 is a view showing one embodiment of a texture knitted of the knitting material according to this invention.

The texture shown in FIG. 2 is obtained by knitting the aforementioned knitting material by a conventional technique, in which 1 is a knitting material comprised of a fine tape according to this invention and 2 is the other yarn clustered therewith which may be a spun yarn, bulky filamentary yarn or the like comprised of one or a mixture of natural fibers, chemical fibers or synthetic fibers. As the yarn 2 to be used with the tape of this invention are yarns of suitable nerve. Relatively fine acrylic bulky spun yarn is most desirable for it, but conventional handicraft yarns may be usable appropriately. Particularly, the use of mohair-like yarns, e.g. cut yarns may give a knitted fabric having an overall fluffy appearance. It is a matter of course that other known textures than the shown texture may be adopted.

In order to color the tape-like materials of this invention, it is preferred to dye the non-woven fabric at the stage when it is prepared according to the spun-bond process and wound up on a roll. High pressure dyeing process and other conventional dyeing processes may be adopted for that purpose, and dyed yarns may be thus readily obtained.

The knitting material according to this invention has a weight of about 32 gr. per 100 meters and a weight per area of 20 g/m$^2$, as compared with a weight of about 50 gr. per 100 meters of a conventional handicraft yarn, for example, ANDARIA 4000 D (a trademark of a product manufactured by Asahi Kasei Kogyo Kabushiki Kaisha) and is thus, lighter in weight by about 40%. Further, the knitting material is washable since it is comprised of a synthetic high polymer, and it may be readily knitted with a knitting machine as well as a knitting needle or crochet needle. It is noteworthy that the knitting material of this invention makes it possible to enlarge the range of handicraft articles and it involves a new use of non-woven fabrics which have been confined to such uses as inside belts, paddings, etc. Furthermore, the knitting material of this invention is abundant in elasticity and flexibility since it is constructed of a non-woven fabric prepared by the spun-bond process, so that when it is knitted, it results in knitted articles having a good elongation recovery, e.g. sweaters, cardigans, shawls, cushions, etc. and besides, when it is used for handicraft purposes, it gives elegant articles of refined taste, dissimlar to articles made of conventional handicraft yarns.

What is claimed is:

1. Knitting material which comprises a fine tape comprised of a non-woven fabric prepared by the spun-bond process, said tape having been prepared by slitting said non-woven fabric lengthwise, said tape having a weight per area of not more than 30 g/m$^2$ and having a width of 5 to 20 mm, said tape having been twisted so as to have, on the average, from 2 to 20 turns per one meter lengthwise.

2. Knitting material as claimed in claim 1, wherein said non-woven fabric comprises at least one of nylon filament, polyester filament and polypropylene filament.

3. Knitting material which comprises a cluster of a fine tape and another yarn, said fine tape being made of a non-woven fabric prepared by the spun-bond process, said tape having been prepared by slitting said non-woven fabric lengthwise, said tape having a weight per area of not more than 30 g/m$^2$ and a width of 5 to 20 mm, said tape having been twisted so as to have, on the average, from 2 to 20 turns per one meter lengthwise, said tape and said another yarn extending lengthwise of each other in side-by-side relationship and defining an elongated strand.

4. A knit article prepared by knitting the knitting material as claimed in claim 3.

5. Knitting material as claimed in claim 1 in which said non-woven fabric consists essentially of continuously spun filaments of synthetic fiber-forming polymer which filaments are intertwined and bonded together vertically and horizontally.

6. Knitting material as claimed in claim 5 in which said tape has a width of 12 to 15 mm.

7. Knitting material as claimed in claim 3 in which said non-woven fabric consists essentially of continuously spun filaments of synthetic fiber-forming polymer which filaments are intertwined and bonded together vertically and horizontally.

8. Knitting material as claimed in claim 7 in which said tape has a width of 12 to 15 mm.

* * * * *